US006493531B2

(12) United States Patent
Choi

(10) Patent No.: US 6,493,531 B2
(45) Date of Patent: Dec. 10, 2002

(54) PHOTORECEPTOR WEB DRYING UNIT OF LIQUID ELECTROPHOTOGRAPHIC PRINTER

(75) Inventor: Jae-myoung Choi, Suwon (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/822,867

(22) Filed: Apr. 2, 2001

(65) Prior Publication Data

US 2002/0090233 A1 Jul. 11, 2002

(30) Foreign Application Priority Data

Jan. 8, 2001 (KR) ..... 2001-917

(51) Int. Cl.[7] ..... G03G 15/11
(52) U.S. Cl. ..... 399/251
(58) Field of Search ..... 399/92, 98, 250, 399/251; 347/102

(56) References Cited

U.S. PATENT DOCUMENTS 3,997,977 A * 12/1976 Katayama et al. ..... 399/251 X
4,248,520 A * 2/1981 Kurita et al. ..... 399/92
5,905,928 A * 5/1999 Shin ..... 399/250
5,978,631 A * 11/1999 Lee ..... 399/251
6,085,055 A * 7/2000 Shin et al. ..... 399/250
6,141,518 A * 10/2000 Shin et al. ..... 399/250
6,178,304 B1 * 1/2001 Sakai ..... 399/251
6,205,317 B1 * 3/2001 Song et al. ..... 399/251 X
6,289,192 B1 * 9/2001 Nukada et al. ..... 399/250

* cited by examiner

*Primary Examiner*—Sandra Brase
(74) *Attorney, Agent, or Firm*—Sughrue Mion, PLLC

(57) ABSTRACT

A photoreceptor web drying unit of a liquid electrophotographic printer includes a plurality of heating sources, installed close to but not contacting a photoreceptor web, for generating heat used for drying and vaporizing liquid carrier, a manifold, encompassing the heating sources, for collecting gas carrier vaporized by the heating sources, a circulation line, forming a closed loop connected to the manifold, for forming a path for circulation of the gas carrier collected in the manifold, an inlet duct, installed at the manifold to be connected to the circulation line, through which the gas carrier vaporized by the heating sources can flow, and a blowing duct, installed at the manifold to be connected to the circulation line, through which air can flow into the manifold. Thus, since the drying unit is formed in a non-contact method with respect to the photoreceptor web, images are not inadvertently picked-up by the drying unit. Also, since the drying unit reduces image defects, the quality of the printed image is improved.

21 Claims, 4 Drawing Sheets

PHOTORECEPTOR WEB DRYING UNIT OF LIQUID ELECTROPHOTOGRAPHIC PRINTER

BACKGROUND OF THE INVENTION

1. Field of the Invention

The present invention relates to a liquid electrophotographic printer and, more particularly, to a photoreceptor web drying unit of a liquid electrophotographic printer for drying and vaporizing liquid carrier including toner adhering to an electrostatic latent image formed on a photoreceptor web.

Priority is claimed from Korean Patent Application No. 01-917, filed on Jan. 8, 2001, which is incorporated herein by reference.

2. Description of the Related Art

In general, an electrophotographic printer is an image forming apparatus for obtaining a desired image by forming an electrostatic latent image on a photosensitive medium such as a photoreceptor web, developing the electrostatic latent image with toner of a predetermined color, and transferring the developed image to a sheet of print paper. The electrophotographic printer is divided into a dry type and a liquid type according to the type of toner in use. The dry electrophotographic printer uses toner in a powdered state while the liquid electrophotographic printer uses liquid developer which is a mixture of volatile liquid carrier and toner. The use of the liquid electrophotographic printer is gradually increasing because the quality of print is superior to that of the dry electrophotographic printer, and simultaneously because damage caused by toxic toner dust is prevented.

FIG. 1 shows the structure of a conventional liquid electrophotographic color printer. Referring to the drawing, a liquid electrophotogrpahic printer 100 adopts a photoreceptor web 110 installed to be capable of circulating along an endless path being supported by a transfer backup roller 121, a steering roller 122 and a driving roller 123, as a photosensitive medium.

A laser scanning unit (LSU) 130 and a developing unit 140 are installed under the photoreceptor web 110. The laser scanning unit 130 forms an electrostatic latent image through exposure by scanning a laser beam onto the photoreceptor web 110 according to an image signal. The developing unit 140 forms the electrostatic latent image formed on the photoreceptor web 110 by making developer including toner of a predetermined color adhere to the electrostatic latent image. For color printing, a plurality of the laser scanning units (LSU) 130 and the developing units 140 are installed so that the electrostatic latent image can be developed for respective colors, as shown in the drawing.

The photoreceptor web 110 circulates in a direction of the arrows indicating the direction of the respective rollers. The photoreceptor web 110 is charged to a predetermined voltage as a charging unit 150 applies charges to the photoreceptor web 110. Here, the laser scanning unit 130 scans a laser beam corresponding to a pattern portion of a particular color onto the photoreceptor web 110. Accordingly, a portion of the photoreceptor web 110 receiving the laser beam is discharged so that a difference in voltage is generated between the portion receiving the laser beam and a portion that does not receive the laser beam.

The developing unit 140 develops developer of a particular color at the portion of the photoreceptor web 110 where charges are lost . A toner image adhering to the electrostatic latent image on the photoreceptor web 110 by the developing unit 140 is transferred to a transfer roller 124 which is installed parallel to the transfer backup roller 121 while the photoreceptor web 110 is interposed between the transfer roller 124 and the transfer backup roller 121. Then, the toner image transferred to the transfer roller 124 is transferred again to a sheet of print paper 126 provided between the transfer roller 124 and a fusing roller 125 installed parallel to the transfer roller 124. Thus, a desired image can be printed.

However, ink provided to the photoreceptor web 110 from the developing unit 140 is a mixture of solid toner and liquid carrier. The toner actually has a color to be printed on the print paper 126 and the carrier serves as a solvent for carrying the toner. Thus, the carrier is dried and vaporized by a drying unit 160 before printing and removed from a transfer surface of the photoreceptor web 110. The developer in a liquid state adhering to the electrostatic latent image of the photoreceptor web 110 is dried because a liquid component of the developer is removed as it passes through the drying unit 160.

The drying unit 160 is installed to be capable of rotating in contact with part of the transfer surface of the photoreceptor web 110. The drying unit 160 includes a drying roller 161 having a heat source 162 for generating heat at the center axis of rotation, a pair of reproduction rollers 163 each having a heat source 164 for generating heat, for example, a heat lamp, at the center axis of rotation as a heating means for heating the drying roller 161 and installed to rotate by being engaged to the drying roller 161, and a manifold 165 encompassing the drying roller 161 and the reproduction rollers 163.

The drying roller 161 has a high temperature because of the heat source 162 installed at the center axis of rotation and the surface of the drying roller 161 is formed of a material capable of absorbing liquid carrier. Also, the drying roller 161 contacts the photoreceptor web 110 by a pressing apparatus (not shown). The reproduction rollers 163 contact the drying roller 161 by the pressing apparatus.

According to the drying unit 160 having the above structure, the drying roller 161 rotating in contact with the photoreceptor web 110 presses liquid carrier of the image ink adhering to the transfer surface of the photoreceptor web 110 so that it adheres to the surface of the drying roller 161. Part of the liquid carrier is vaporized on the surface of the drying roller 161.

The reproduction rollers 163 are heated by each heat source 164 to a particular temperature, drying and vaporizing the liquid carrier absorbed by the drying roller 161. The vaporized carrier is collected by the manifold 165.

However, since the conventional photoreceptor web drying unit 160, as above, vaporizes and absorbs the liquid carrier on a contact surface between the drying roller 161 and the photoreceptor web 110, the contact time therebetween is so short that a sufficient amount of liquid carrier cannot be absorbed. Accordingly, the liquid carrier which is not vaporized and remains on the photoreceptor web 110 is absorbed by the transfer roller 124 so that a paper jam phenomenon occurs.

Also, when images are continuously printed, since the image on the photoreceptor web is not sufficiently dried, an image defect phenomenon, that is, an image is not transferred to a sheet of print paper, is generated.

Further, since the conventional photoreceptor web drying unit 160 uses a contact method, the image on the surface of the photoreceptor web 110 is picked up and transferred to the surface of the drying roller 161 and/or the reproduction rollers 163. Thus, the performance of the drying roller 161 and the reproduction rollers 163 is lowered. The picking up of the image from the surface of the photoreceptor web 110 causes a deterioration of image printing quality.

SUMMARY OF THE INVENTION

To solve the above problems, it is an objective of the present invention to provide a photoreceptor web drying unit of a liquid electrophotographic printer having an improved structure which can improve efficiency in drying and vaporization of liquid carrier adhering to the photoreceptor web.

Accordingly, to achieve the above objective, there is provided a photoreceptor web drying unit of a liquid electrophotographic printer comprising a plurality of heating sources, a manifold, a circulation line, an inlet duct, and a blowing duct.

The plurality of heating sources generate heat and are installed close to, but not contacting, a photoreceptor web, thereby drying and vaporizing liquid carrier on the surface of the photoreceptor web.

The manifold partially surrounds the heating sources, having an opening shaped to face a surface of the photoreceptor web. When the drying unit is positioned proximate to the photoreceptor web, the manifold, and the surface of the photoreceptor belt at the opening in the manifold, substantially encompass the heating sources so that the carrier, in a gaseous state after being vaporized by the heating sources, is contained for collection.

The circulation line forms a path for circulation of the gas carrier collected from within the manifold, and is connected to the manifold to form a closed loop. The gas of the vaporized carrier exits the manifold and enters the circulation line at the inlet duct. After passing through the circulation line, air from the gas reenters the manifold through the blowing duct, generating air flow into the manifold.

BRIEF DESCRIPTION OF THE DRAWINGS

The above objective and advantages of the present invention will become more apparent by describing in detail a preferred embodiment thereof with reference to the attached drawings, in which.

DETAILED DESCRIPTION OF THE INVENTION

Figure 1:
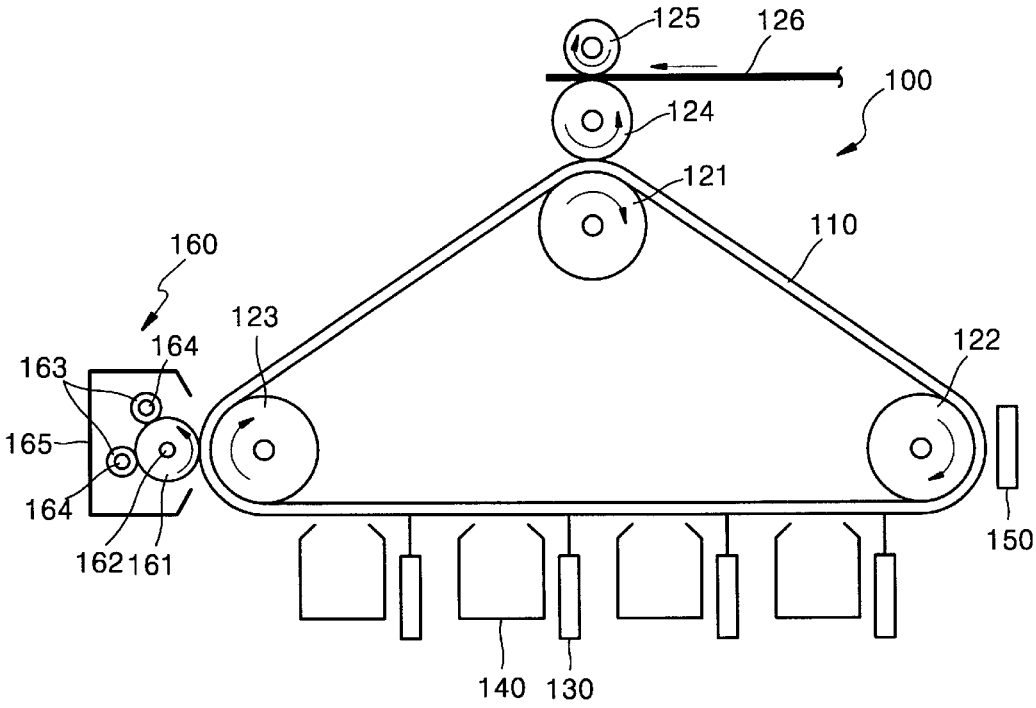
FIG. 1(PRIOR ART)
FIG. 1 is a view showing the structure of a liquid electrophotographic printer having a csnventional photoreceptor web drying unit.

In the description below, the same reference numerals as those described in FIG. 1 indicate the same elements having the same functions.

Figure 2:
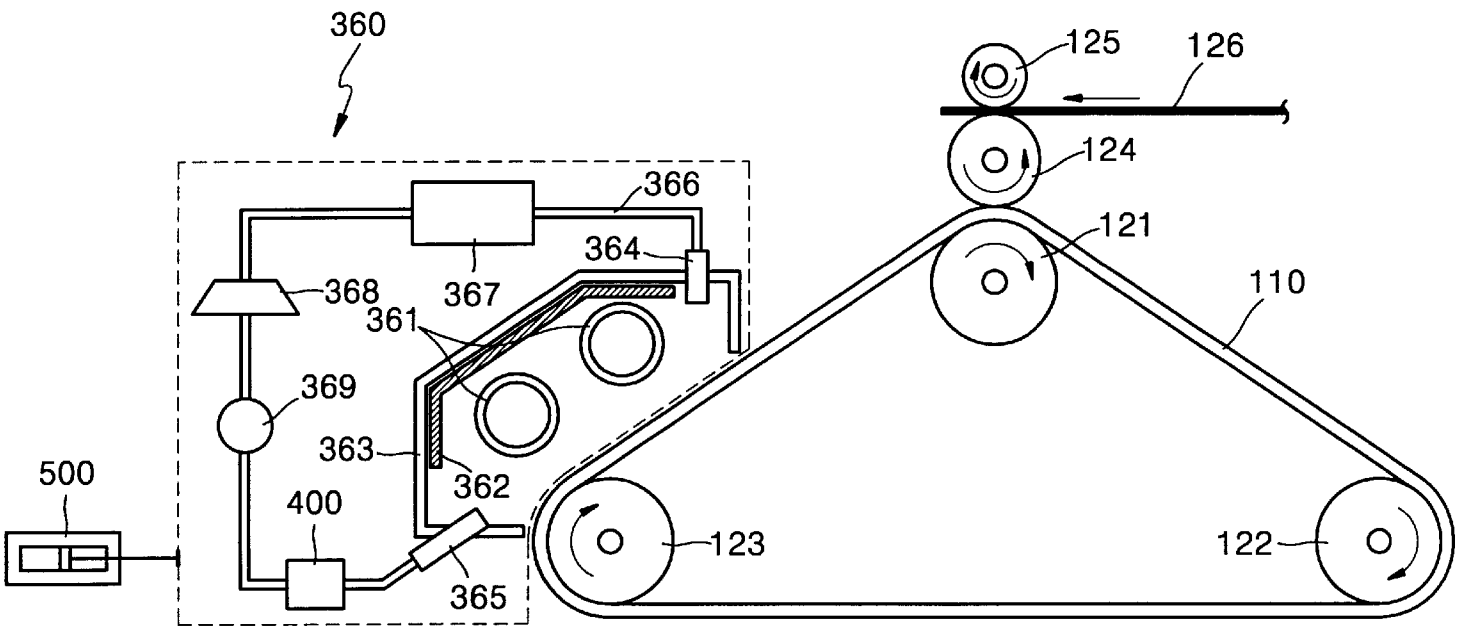
FIG. 2 is a view showing the structure of a photoreceptor web drying unit of a liquid electrophotographic printer according to a preferred embodiment of the present invention.

Referring to FIG. 2, a photoreceptor web drying unit 360 of a liquid electrophotographic printer according to a preferred embodiment of the present invention includes a plurality of heating sources 361 for generating a radiant heat to vaporize liquid carrier adhering to the surface of the photoreceptor web 110, a reflection plate 362 for reflecting the radiant heat generated by the heating sources 361 toward the photoreceptor web 110, and a manifold 363 encompassing the reflection plate 362 and the heating sources 361 to form space for collecting gas carrier.

Also, the photoreceptor web drying unit 360 includes a circulation line 366 forming a path for circulation of gaseous liquid collected in the manifold 363 by being connected to the manifold 363 and forming a closed loop, and an inlet duct 364 and blowing duct 365 installed in the manifold 363 to be connected to the circulation line 366.

Installed on the circulation path 366 are a condenser 367 for condensing a high temperature, high density gas carrier to a low temperature, low density gas carrier, a filter 368 for filtering the remaining amount of carrier passing through the condenser 367, and a plurality of pumps 369 for making air circulate along the circulation line 366.

The heating sources 361 are installed parallel to a width (not shown) of the photoreceptor web 110 and close to but not contacting the photoreceptor web 110. Heat generated by the heating sources 361 is radiated to the photoreceptor web 110 so that liquid carrier adhering to the photoreceptor web 110 is vaporized.

Also, a plurality of heating sources 361 are preferably installed parallel to each other and separated a predetermined distance from each other. Thus, the area in which the heat generated by the heating sources 361 is radiated to the photoreceptor web 110 increases so that the amount of the liquid carrier vaporized from the photoreceptor web 110 can be increased.

Preferably, a far infrared heater may be used as the heating sources 361. A far infrared ray has a feature of a strong thermal function compared to a visible ray or an ultraviolet ray and thus it is referred to as a heat ray. In particular, since the wavelength of the far infrared ray coincides with a natural frequency that a high molecular weight substance has, expedition of molecular movement by resonance makes absorbance of radiant energy easy.

As a result, the time for heating and drying is shortened and the inner and outer portions of an object subject to heating are uniformly heated. Thus, in the present invention, the feature of a far infrared ray is utilized to vaporize liquid carrier adhering to the photoreceptor web 110. It is preferable in the present invention that a far infrared ray having a wavelength within a range of 25–1000 $\mu$m is used to vaporize the liquid carrier adhering to the photoreceptor web 110.

The manifold 363, together with a surface of the photoreceptor belt 110 at an opening in the manifold, encompass the heating sources 361 to form a closed space to collect the gas carrier vaporized from the photoreceptor web 110.

The reflection plate 362 is installed at an inner wall of manifold 363 alongside the heating sources 361. The heat radiated from the heating sources 361 toward the reflection plate 362 is reflected by the reflection plate 362 toward the photoreceptor web 110 and transferred to the photoreceptor web 110. Thus, the radiant heat generated by the heating sources 361 helps vaporization of the liquid carrier adhering to the surface of the photoreceptor web 110. As a result, loss of radiant heat is prevented while increasing the efficiency thereof.

The inlet duct 364 is preferably installed at an upper portion of the manifold 363 so that the gas carrier vaporized from the photoreceptor web 110 and collected by the manifold 363 easily enters the circulation line 366. The blowing duct 365 is installed at a lower portion of the manifold 363 and is preferably aligned parallel to the surface of the photoreceptor web 110 at the opening in the manifold 363. Preferably, the air entering the manifold 363 through the blowing duct 365 flows in a tangential direction with respect to the photoreceptor web 110 so that the gas carrier vaporized from the photoreceptor web 110 by the heating sources 361 can be easily blown into the inlet duct 364.

Also, an additional heat source 400 may be installed in the circulation line 366 at a point before the air passes into the blowing duct 365 to increase the temperature of the air inside the manifold 363. That is, by increasing the temperature of the air entering the manifold 363, the liquid carrier adhering to the photoreceptor web 110 is more easily vaporized by the heating sources 361.

The drying unit 360 further includes a drying unit moving mechanism 500, which moves the drying unit 360 close to the photoreceptor web 110 in a print mode, and which moves the drying unit 360 away from the photoreceptor web 110 in a stop mode or a ready mode. The drying unit moving mechanism 500 may comprise, for example, a piston cylinder or a reciprocating means.

Figure 4A:
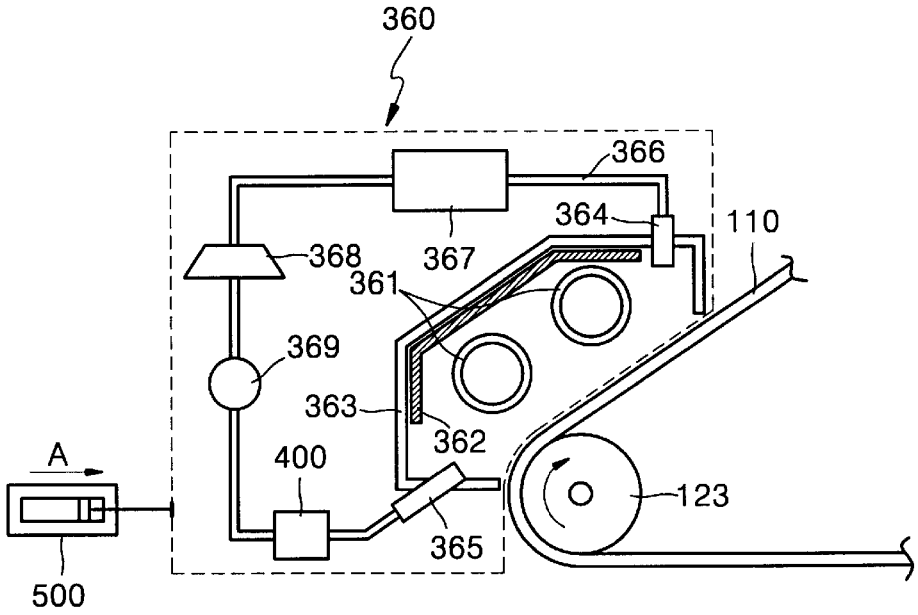
FIG. 4A is a view showing the position of the photoreceptor web drying unit of a liquid electrophotographic printer of the present invention with respect to the photoreceptor web in a print mode.
Figure 4B:
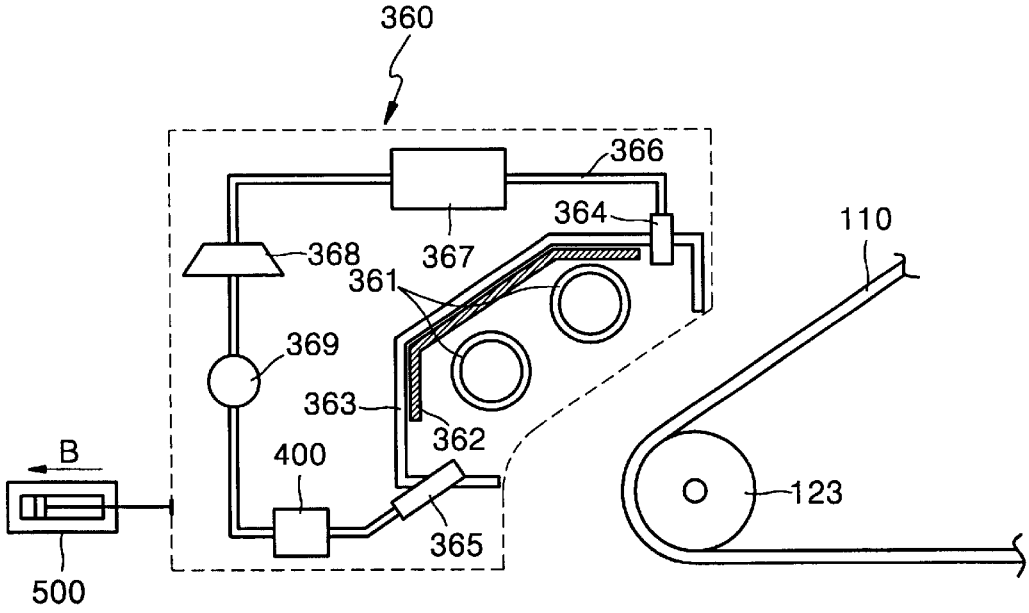
FIG. 4B is a view showing the position of the photoreceptor web drying unit of a liquid electrophotographic printer of the present invention with respect to the photoreceptor web in a stop mode or a ready mode.

FIG. 4A is a view showing the position of the photoreceptor web drying unit of a liquid electrophotographic printer according to a preferred embodiment of the present invention when it is in a print mode. FIG. 4B is a view showing the position of the photoreceptor web drying unit of a liquid electrophotographic printer according to a preferred embodiment of the present invention when it is in a stop or ready mode.

In the operation of the above photoreceptor web drying unit of a liquid efectrophotographic printer, referring to FIG. 4A, in a print mode, the photoreceptor web 110 rotates in contact with the transfer backup roller 121, the steering roller 122, and the driving roller 123. Here, the drying unit 360 in a position as shown in FIG. 4B is moved by the drying unit moving mechanism 500 in a direction indicated by an arrow A, close to the photoreceptor web 110.

Simultaneously, referring to FIG. 2, the heating sources 361 generate radiant heat by application of an external voltage (not shown) and the generated radiant heat is radiated to the photoreceptor web 110 so that liquid carrier adhering to the surface of the photoreceptor web 110 is vaporized. Here, the reflection plate 362, installed inside the manifold 363 alongside the heating sources 361, reflects the radiant heat radiated from the heating sources 361, so that the radiant heat otherwise directed away from the photoreceptor web is redirected toward the photoreceptor web 110.

Also, the pumps 369 installed on the circulation line 366 are operated by an external voltage (not shown) to make air enter the manifold 363 through the blowing duct 365.

Figure 3:
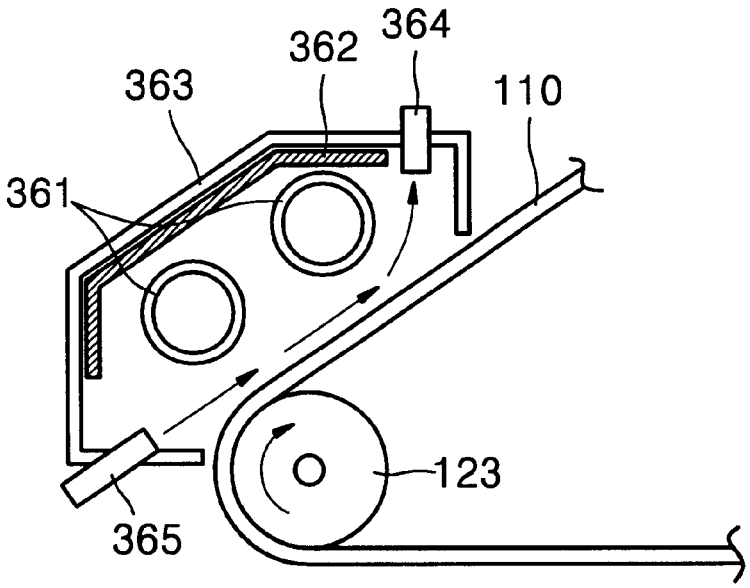
FiG 3 is a view showing the flow of air in photoreceptor web drying unit of FIG. 2.

FIG. 3 is a view showing the flow of air in the photoreceptor web drying unit of the present invention. Referring to the drawing, air flowing in a tangential direction with respect to the photoreceptor web 110 moves the gas of the carrier vaporized from the photoreceptor web 110 toward the inlet duct 364, thereby helping the gaseous carrier to enter the inlet duct 364.

The temperature of the gaseous carrier after it enters the circulation line 366 at the inlet duct 364 is lowered as it passes through the condenser 367, thereby acquiring a low temperature, low density state. The gaseous carrier, after passing through the condenser 367, is filtered while passing through the filter 368. Here the carrier is collected by a carrier collecting unit (not shown).

Since most carrier is filtered while passing through the filter 368, only air passes through the filter 368. The air reenters the manifold 363 through the blowing duct 365 after passing the pumps 369.

Also, the air heated by the additional heat source 400, installed between the pumps 369 and the blowing duct 365, and supplied to the manifold 363 increases the temperature within the manifold 363. Thus, the amount of gas carrier vaporized by the heating sources 361 increases.

Referring to FIG. 4B, in a stop or ready mode after printing is completed, the radiant heat generated by the heating sources 361 does not disappear immediately after the external voltage is cut off and a latent heat remains for a predetermined time. Part of the photoreceptor web 110 where radiation of the latent heat is concentrated can be deformed by the latent heat. Thus, the drying unit 360 is moved in a direction indicated by an arrow B by the drying unit moving mechanism 500 in a stop or ready mode so as to be separated from the photoreceptor web 110.

In a print mode, as shown in FIG. 4A, the drying unit 360 is moved by the drying unit moving mechanism 500 close to the photoreceptor web 110 and performs the above operation.

As described above, the photoreceptor web drying unit of a liquid electrophotographic printer according to the present invention has the following advantages.

First, since the drying unit is formed in a non-contact method so that the drying unit does not contact the photoreceptor web, the phenomenon of an image being picked up by the drying apparatus is prevented. Since an image is transferred to a transfer unit in an optimal drying state without causing a defect to the image, image quality is improved.

Second, since maintenance of the drying unit is simplified and does not require regular replacement of the unit, a semi-permanent drying unit is obtained.

Third, since the quality of a drying state does not change during a continuous printing, a uniform image can be continuously obtained.

It is contemplated that numerous modifications may be made to the drying unit of the present invention without departing from the spirit and scope of the invention as defined in the following claims.

What is claimed is:

1. A photoreceptor web drying unit of a liquid electrophotographic printer comprising:

a plurality of heating sources, installed close to but not contacting a photoreceptor web, which generate heat for drying and vaporizing liquid carrier on the photoreceptor web;

a manifold, partially surrounding said plurality of heating source, having an opening shaped to face a surface of the photoreceptor web, for collecting a gas of liquid carrier vaporized by said plurality of heating sources;

a circulation line, forming a closed loop circulation path for the gas collected from within the manifold, connected to the manifold;

an inlet duct, installed at the manifold and connected to the circulation line, through which the liquid carrier vaporized by the heating sources enters the circulation line from the manifold in a gaseous state;

a blowing duct, installed at the manifold and connected to the circulation line, through which air flows from the circulation line into the manifold; and an additional heat source installed on the circulation line, increasing the temperature of air entering said manifold through said blowing duct to a predetermined degree, wherein, when said photoreceptor web drying unit is positioned proximate to the photoreceptor web, said manifold and the surface of the photoreceptor belt at the opening in the manifold substantially encompass the heating sources so that the liquid carrier, in a gaseous state after being vaporized by the heating sources, is contained for collection through said inlet duct.

2. The photoreceptor web drying unit as claimed in claim 1, wherein said plurality of heating sources are far infrared heaters.

3. The photoreceptor web drying unit as claimed in claim 2, wherein each far infrared heater emits a far infrared ray having a wavelength within a range of 25–1000 $\mu$m.

4. The photoreceptor web drying unit as claimed in claim 1, wherein said plurality of heating sources are installed parallel to the photoreceptor web and separated a predetermined distance from one another.

5. The photoreceptor web drying unit as claimed in claim 1, further comprising a reflection plate, installed at an inner wall of the manifold alongside the heating sources, reflecting heat generated by the heating sources toward the opening in the manifold, wherein, when said photoreceptor web drying unit is positioned proximate to the photoreceptor web, heat is reflected onto a surface of the photoreceptor web at the opening.

6. The photoreceptor web drying unit as claimed in claim 1, further comprising at least one pump installed on the circulation line for making the gaseous carrier circulate along the circulation line.

7. The photoreceptor web drying unit as claimed in claim 1, further comprising a condenser installed on the circulation line, cooling and condensing the gaseous carrier circulating along the circulation line.

8. The photoreceptor web drying unit as claimed in claim 7, further comprising a filter installed on the circulation line, separating liquid carrier condensed by said condenser from air flowing along the circulation line.

9. The photoreceptor web drying unit as claimed in claim 1, wherein the inlet duct is installed at an upper portion of said manifold.

10. The photoreceptor web drying unit as claimed in claim 1, further comprising a drying unit moving mechanism which selectively moves the drying unit close to the photoreceptor web in a print mode, and which moves the drying unit away from the photoreceptor web in a stop mode or a ready mode, whereby deformation of the photoreceptor web caused by latent heat is prevented when not in the print mode.

11. A photoreceptor web drying unit of a liquid electrophotographic printer comprising:

a plurality of heating sources, installed close to but not contacting a photoreceptor web, which generate heat for drying and vaporizing liquid carrier on the photoreceptor web;

a manifold, partially surrounding said plurality of heating source, having an opening shaped to face a surface of the photoreceptor web, for collecting a gas of liquid carrier vaporized by said plurality of heating sources;

a circulation line, forming a closed loop circulation path for the gas collected from within the manifold, connected to the manifold;

an inlet duct, installed at the manifold and connected to the circulation line, through which the liquid carrier vaporized by the heating sources enters the circulation line from the manifold in a gaseous state; and a blowing duct, installed at the manifold and connected to the circulation line, through which air flows from the circulation line into the manifold, wherein, when said photoreceptor web drying unit is positioned proximate to the photoreceptor web, said manifold and the surface of the photoreceptor belt at the opening in the manifold substantially encompass the heating sources so that the liquid carrier, in a gaseous state after being vaporized by the heating sources, is contained for collection through said inlet duct, wherein the blowing duct is installed at a lower portion of said manifold and aligned parallel to a plane intersecting edges of the opening in said manifold, the plane being parallel with the surface of the photoreceptor belt at the opening when said photoreceptor web drying unit is positioned proximate to the photoreceptor web, and wherein, when said photoreceptor web drying unit is positioned proximate to the photoreceptor web, air flows from said blowing duct toward said inlet duct, facilitating collection of the gas carrier vaporized from the surface of the photoreceptor web.

12. The photoreceptor web drying unit as claimed in claim 11, wherein said plurality of heating sources are far infrared heaters.

13. The photoreceptor web drying unit as claimed in claim 12, wherein each far infrared heater emits a far infrared ray having a wavelength within a range of 25–1000 $\mu$m.

14. The photoreceptor web drying unit as claimed in claim 11, wherein said plurality of heating sources are installed parallel to the photoreceptor web and separated a predetermined distance from one another.

15. The photoreceptor web drying unit as claimed in claim 11, further comprising a reflection plate, installed at an inner wall of the manifold alongside the heating sources, reflecting heat generated by the heating sources toward the opening in the manifold, wherein, when said photoreceptor web drying unit is positioned proximate to the photoreceptor web, heat is reflected onto a surface of the photoreceptor web at the opening.

16. The photoreceptor web drying unit as claimed in claim 11, further comprising at least one pump installed on the circulation line for making the gaseous carrier circulate along the circulation line.

17. The photoreceptor web drying unit as claimed in claim 11, further comprising a condenser installed on the circulation line, cooling and condensing the gaseous carrier circulating along the circulation line.

18. The photoreceptor web drying unit as claimed in claim 17, further comprising a filter installed on the circulation line, separating liquid carrier condensed by said condenser from air flowing along the circulation line.

19. The photoreceptor web drying unit as claimed in claim 11, further comprising an additional heat source installed on the circulation line, increasing the temperature of air entering said manifold through said blowing duct to a predetermined degree.

20. The photoreceptor web drying unit as claimed in claim 11, wherein the inlet duct is installed at an upper portion of said manifold.

21. The photoreceptor web drying unit as claimed in claim 11, further comprising a drying unit moving mechanism which selectively moves the drying unit close to the photoreceptor web in a print mode, and which moves the drying unit away from the photoreceptor web in a stop mode or a ready mode, whereby deformation of the photoreceptor web caused by latent heat is prevented when not in the print mode.

* * * * *